United States Patent [19]

Hornby et al.

[11] Patent Number: 5,035,224

[45] Date of Patent: Jul. 30, 1991

[54] CLIP RETENTION OF A SPLIT-STREAM FUEL INJECTOR TO A FUEL RAIL CUP INCLUDING CIRCUMFERENTIAL LOCATOR

[75] Inventors: Michael J. Hornby, Williamsburg; Dean Spiers, Hampton; Stephen Cranford, Newport News, all of Va.

[73] Assignee: Siemens Automotive L.P., Auburn Hills, Mich.

[21] Appl. No.: 549,326

[22] Filed: Jul. 6, 1990

[51] Int. Cl.[5] ..... F02M 37/04

[52] U.S. Cl. ..... 123/470; 123/456

[58] Field of Search ..... 123/470, 472, 468, 469, 123/456; 239/600, 585, 550, 551

[56] References Cited

U.S. PATENT DOCUMENTS

| | | | |
|---|---|---|---|
| 4,240,384 | 12/1980 | Urbinati et al. | 123/470 |
| 4,294,215 | 10/1981 | Hans et al. | 123/470 |
| 4,307,693 | 12/1981 | Glockler et al. | 123/470 |
| 4,395,988 | 8/1983 | Knapp | 123/469 |
| 4,474,159 | 10/1984 | Katnik | 123/468 |
| 4,474,160 | 10/1984 | Gartner | 123/468 |
| 4,475,516 | 10/1984 | Atkins et al. | 123/470 |
| 4,539,961 | 9/1985 | Atkins et al. | 123/468 |
| 4,570,602 | 2/1986 | Atkins et al. | 123/468 |
| 4,823,754 | 4/1989 | Minamoto et al. | 123/470 |
| 4,899,712 | 2/1990 | Bruyn et al. | 123/468 |
| 4,909,221 | 3/1990 | Heuser | 123/456 |
| 4,950,171 | 8/1990 | Muzslay | 123/470 |
| 4,971,014 | 11/1990 | Usui | 123/470 |
| 4,979,295 | 12/1990 | Stagni | 123/470 |
| 4,984,548 | 1/1991 | Hudson | 123/470 |

*Primary Examiner*—Carl Stuart Miller

*Attorney, Agent, or Firm*—George L. Boller; Russel C. Wells

[57] ABSTRACT

The cup into which the injector inlet is inserted has a radial key on its lip which requires that the retention clip have a proper circumferential orientation for registration with the key in order to permit the full assembly of the injector to the cup to be achieved when the injector, with the clip attached thereto, is inserted into the cup. The key is formed during the cup fabrication process out of metal that would otherwise be a part of the offal stock that is trimmed from the perimeter of the blank after the blank has been drawn to form the cup.

2 Claims, 2 Drawing Sheets

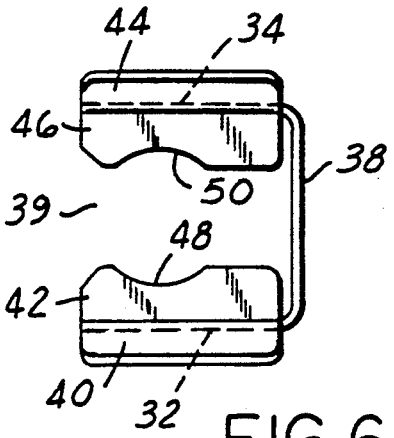
FIG.6
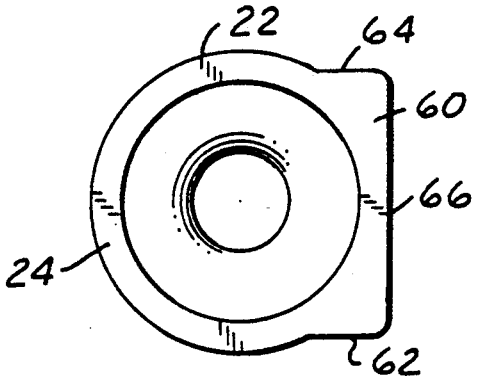
FIG.5
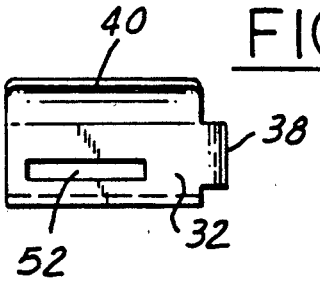
FIG.7
FIG.8
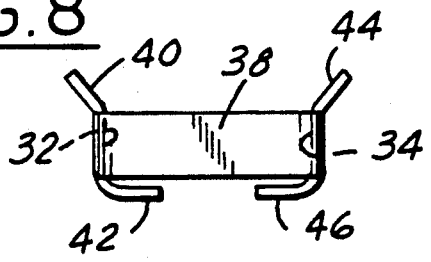

CLIP RETENTION OF A SPLIT-STREAM FUEL INJECTOR TO A FUEL RAIL CUP INCLUDING CIRCUMFERENTIAL LOCATOR

BACKGROUND AND SUMMARY OF THE INVENTION

This invention relates to the assembly and mechanical retention of an electromagnetic fuel injector on a fuel rail cup.

It is known to use spring metal clips for the mechanical retention of an electromagnetic fuel injector on a fuel rail cup.

Examples are shown in U.S. Pat. No(s). 4,474,160; 4,475,516; and 4,539,961. The spring retention clip which will be illustrated and described in the ensuing description of a preferred embodiment has heretofore been used for mechanical retention of a fuel injector on a fuel rail cup, and hence the clip, per se, is not novel.

Certain internal combustion engines have two intake valves per cylinder, and when a fuel injection system is used in such engines, it is usually desirable to employ an injector of the split-stream type for each cylinder. Such an injector splits the injected fuel stream into one portion directed toward one valve and another portion directed toward the other valve. In order for the split streams to be properly aimed, it is necessary for the injector to be properly circumferentially located in the fuel rail cup. It is also desirable to make the assembly of the injector to the cup inherently properly circumferentially located in the injector.

In one prior construction for circumferentially locating the injector in the cup, an additional block was added to the rail. This block had flats machined into it, and retention clips were redesigned for coaction with the block in locating the injectors. The wiring harness to the injectors also had to be made into a bus bar orienting the injectors. This prior construction increased the number of parts involved in a given engine system and it required certain redesign of the clip.

The present invention relates to a construction which retains the use of the illustrated retention clip, and adds essentially no cost to the manufacture of either the injector or the cup. The invention involves the creation of a key in the heretofore purely circular lip of the cup. This key has a coaction with the clip causing the injector to be properly circumferentially located at assembly to the cup. The material used to form the key would otherwise be part of the offal stock that is trimmed from the perimeter of the blank after the cup has been drawn. Accordingly, the material of the key is free, and the only modification required to the prior fabrication of the cup is to change the shape of the trim die so that the key is included in the cup's lip. Thus, the invention enables circumferential location of the injector to the cup to be obtained without having to modify the current injector or the current retention clip, thereby saving on the costs that would otherwise be involved with the prior approach described above.

Further features, advantages, and benefits of the invention will also appear in the detailed description of a preferred embodiment of the invention. Drawings accompany this disclosure and represent the best mode contemplated at this time for carrying out the invention.

BRIEF DESCRIPTION OF THE DRAWINGS

FIG. 5 is an axial end view of the cup.

FIG. 6 is an axial end view of the retention clip used in the assembly.

FIG. 7 is a front elevational view of FIG. 6.

FIG. 8 is a right side view of FIG. 7.

DESCRIPTION OF A PREFERRED EMBODIMENT

Figure 1:
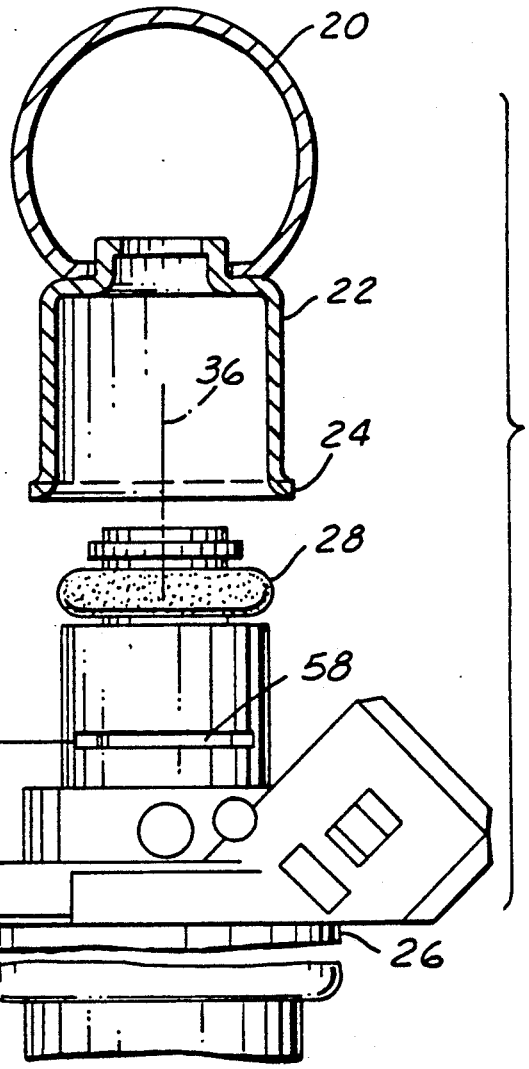
FIG. 1 is an exploded elevational view, partly in section and partly broken away, illustrating the preferred embodiment of the invention.

A cylindrical fuel rail 20 has a number of cups 22 corresponding to the number of engine cylinders served by the rail and located at appropriate intervals along the rail's length. Each cup 22 is cylindrical in shape and comprises a radially outwardly directed lip 24 at its rim.

An electromagnetic fuel injector 26 is assembled to each cup 22 by inserting the inlet end of the injector into the cup. An O-ring seal 28 disposed in a circular groove in the injector body seals the injector to the cup so that the liquid fuel which passes from the rail to the injector's fuel inlet does not leak from the joint. The assembly of the fuel injector to the cup is retained by a resilient metal clip 30, one portion of the clip being engaged with the injector and another portion with the cup.

Clip 30 comprises first and second side walls 32, 34 respectively, which in the assembly extend axially of the injector's axis 36 and are disposed on diametrically opposite sides of the injector, axially overlapping both the injector and the cup. The clip also comprises a third axially extending side wall 38 which joins side walls 32, 34 such that when the clip is viewed axially as in FIGS. 3, 4 or 6, the walls 32, 34, 38 represent a general channel shape having an entrance 39 that is diametrically opposite side wall 38. Flanges 40, 42 are on side wall 32, and flanges 44, 46 are on side wall 34. Flanges 40 and 44 diverge from their respective side walls toward the fuel rail while flanges 42, 46 are directed toward each other (See FIG. 8). The distal edges of flanges 42, 46 are essentially parallel and spaced apart from each other, except at juxtaposed regions which are shaped to have concave accurate shapes 48, 50. Each side wall 32, 34 also comprises a corresponding through-slot 52, 54 whose lengths are parallel to flanges 42, 46.

Injector has slots 56, 58 on diametrically opposite sides. These slots are arranged parallel with each other and transverse to the injector axis. The shape and arrangement of the slots can be best seen in FIGS. 1 and 4.

In accordance with the invention, a radially extending key 60 is provided on the lip 24 of cup 22. The shape of the key is seen in FIG. 5 to comprise parallel edges 62, 64 on opposite side and an outer edge 66 which is at right angles to edges 62, 64. The key is advantageously formed during the process of making cup 22 from what would otherwise be a part of the offal stock that is trimmed away from the blank from which the cup is drawn. Key 60 coacts with the clip's side walls 32, 34 to provide proper circumferential locating of the injector about axis 36 in assembly.

The process of assembly is as follows. Clip 30 is first assembled onto injector 26 by disposing the clip radially of the injector with entrance 39 toward the injector and with flanges 42, 46 aligned with slots 56, 58. The clip is then advanced radially toward the injector. Flanges 42, 46 enter the respective slots 56, 58. The flanges and slots are shaped such that the interaction between the injector and the advancing clip spreads the flanges apart to allow them to pass onto the injector, and once the clip has been sufficiently advanced, to resiliently return to grip the injector in the manner illustrated by FIG. 4.

Figure 2:
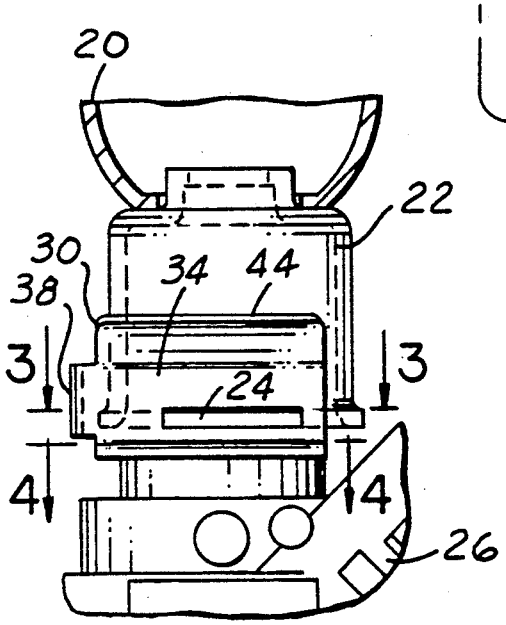
FIG. 2 is a fragmentary view in the same direction as FIG. 1 illustrating the several parts in assembly.
Figure 3:
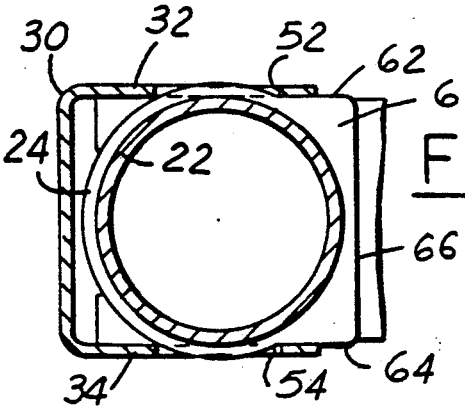
FIG. 3 is transverse cross section in the direction of arrows 3—3 in FIG. 2.
Figure 4:
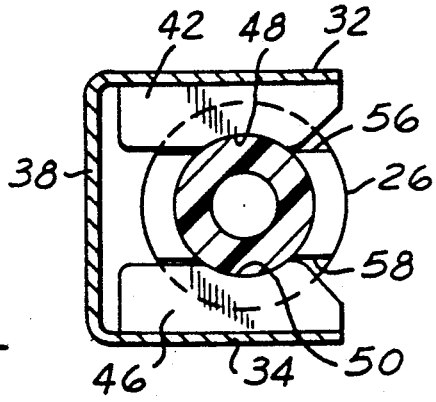
FIG. 4 is a transverse cross section in the direction of arrows 4—4 in FIG. 2.

The next step in the assembly procedure is to axially align the inlet end of the injector with cup 22, and to axially advance the injector toward the cup. It is during this step of the assembly process that the invention comes into play. Because of the presence of key 60 on lip 24, it is necessary that the injector be properly circumferentially oriented relative to the cup in order for the assembly to be properly completed. The step of advancing the injector toward the cup comprises an initial engagement of the cup's lip by flanges 40, 44. This provides a centering force to center the injector, and the flange/lip interaction has a camming effect, flexing the side walls 32, 34 outwardly enough to allow the side walls to pass along the cup lip but not to allow the injector to escape the grip of flanges 42, 46. If, however, the injector is not properly circumferentially oriented with the cup, there will be an interference with key 60 which prevents the further advancement of the injector onto the cup. It is only when the clip side walls 32, 34 are essentially parallel with edges 62, 64 of key 60 that the key allows the injector to be advanced to final position of proper installation. In that final position slots 52, 54 have registered with diametrically opposite segments of the lip 24 resulting in the resiliency of the clip being effective to cause these diametrically opposite segments of the lip to be disposed in the respective slots as shown in FIGS. 2 and 3. FIG. 3 also shows the circumferential locating effect of the key with the side walls 32, 34. Disassembly is accomplished by removing the clip radially of the assembled injector and cup, and then pulling the injector out of the cup.

In a typical engine installation, the fuel rail and assembled injectors are a unit assembly that is fastened to the engine. Locating of the fuel rail to the engine defines the orientation of the injector cups to their respective cylinders. Because the invention assures proper location of the injectors to the cups, proper orientation of the injectors to the respective engine cylinders is also inherently assured, including the proper circumferential orientation that is vital for a split-stream injector. It is to be understood that the precision to which the circumferential orientation occurs is a function of part dimensioning and tolerances. Thus, proper circumferential orientation may be defined to encompass a small angular range, say 5° to 15°, and it is to be understood that this is still considered proper orientation. Likewise, a 180 degree reversal of the clip could still accomplish the desired effect, assuming that the injector provides proper clearance to allow the clip to be installed and removed. Moreover, the process of assembly could comprise first inserting the injector into the cup, and thereafter assembling the clip to retain them. Thus, while a preferred embodiment of the invention has been illustrated and described, principles may be practiced in other ways which are equivalent to the following claims.

What is claimed is:

1. In an internal combustion engine fuel injection system having a fuel rail through which pressurized liquid fuel is supplied to an electrically controlled fuel injector assembled to said fuel rail, the assembly of said fuel injector to said fuel rail comprising a cup which is on said fuel rail and within which a fuel inlet at one axial end of said injector is sealedly disposed, and a one-piece retention clip mechanically engaging both said cup and said fuel injector for mechanical retention of the latter on the former, said fuel injector comprising slot structure formed in an exterior surface thereof and lying in a plane that is transverse to the axis of said fuel injector, said cup comprising a radially outwardly directed lip, said retention clip comprising first and second axially extending side wall portions disposed diametrically opposite each other and axially overlapping the assembled cup and fuel injector, and a third axially extending side wall portion joining said first and second axially extending side wall portions such that, when said clip is viewed axially, said first, second, and third side wall portions present a general channel shape having an entrance that is diametrically opposite said third side wall portion, said first and second side wall portions comprising radially inwardly directed flanges coacting with said exterior surface of said fuel injector including said slot structure thereof to locate said injector both axially and circumferentially relative to said clip, said clip further comprising its own slot structure arranged generally transverse to the injector axis, said slot structure of said clip coacting with said lip such that said clip is located axially relative to said cup to thereby locate the injector axially relative to said cup, said clip being resiliently expansible for enlargement of said entrance to allow said injector to pass through said entrance preparatory to assembly of said injector to said cup and become axially and circumferentially located relative to said clip by the coaction of said flanges with said injector's slot structure and also to allow said clip to be displaced axially onto said cup at assembly of said injector to said cup to coact said clip's slot structure with said cup's lip for axially locating said cup and said clip to each other;

the improvement which comprises means for also circumferentially locating said clip to said cup at assembly of said injector to said cup, and hence circumferentially locating said injector to said cup, said means of the improvement comprising a radial key on said lip, said key coacting with said first and second side wall portions of said clip to circumferentially locate said cup to said injector.

2. The improvement set forth in claim 1 wherein said said key is disposed at said entrance.

* * * * *